US011363377B2

(12) United States Patent
Deruty et al.

(10) Patent No.: US 11,363,377 B2
(45) Date of Patent: Jun. 14, 2022

(54) AUDIO PROCESSING

(71) Applicant: Sony Europe B.V., Surrey (GB)

(72) Inventors: Emmanuel Deruty, Stuttgart (DE); Stéphane Rivaud, Stuttgart (DE)

(73) Assignee: SONY EUROPE B.V., Surrey (GB)

( * ) Notice: Subject to any disclaimer, the term of this patent is extended or adjusted under 35 U.S.C. 154(b) by 0 days.

(21) Appl. No.: 16/756,141

(22) PCT Filed: Oct. 12, 2018

(86) PCT No.: PCT/EP2018/077834

§ 371 (c)(1),
(2) Date: Apr. 15, 2020

(87) PCT Pub. No.: WO2019/076739

PCT Pub. Date: Apr. 25, 2019

(65) Prior Publication Data

US 2021/0195326 A1 Jun. 24, 2021

(30) Foreign Application Priority Data

Oct. 16, 2017 (EP) ..... 17196652

(51) Int. Cl.
*H04R 3/02* (2006.01)
*G10L 19/008* (2013.01)
*G10L 25/06* (2013.01)

(52) U.S. Cl.
CPC ..... *H04R 3/02* (2013.01); *G10L 19/008* (2013.01); *G10L 25/06* (2013.01)

(58) Field of Classification Search
CPC ..... G10L 19/008; G10L 21/034; G10L 19/00; G10L 21/0316; G10L 25/06; H04S 3/008; H04S 7/00
USPC ..... 381/119, 106, 107, 108, 22, 23
See application file for complete search history.

(56) References Cited

U.S. PATENT DOCUMENTS

2003/0040910 A1* 2/2003 Bruwer ..... H04R 27/00 704/266
2006/0029239 A1 2/2006 Smithers
2006/0045291 A1* 3/2006 Smith ..... H04S 7/30 381/119
2006/0178870 A1 8/2006 Breebaart et al.
2006/0233379 A1* 10/2006 Villemoes ..... G10L 19/008 381/23

(Continued)

OTHER PUBLICATIONS

International Search Report and Written Opinion dated Jan. 4, 2019 for PCT/EP2018/077834 filed on Oct. 12, 2018, 12 pages.

(Continued)

*Primary Examiner* — Alexander Krzystan
(74) *Attorney, Agent, or Firm* — Xsensus LLP

(57) ABSTRACT

An audio processing method comprises: for each given input digital audio signal of a set of two or more input digital audio signals, detecting a correlation between the given input digital audio signal and others of the input digital audio signals; generating a gain adjustment for application to the given input digital audio signal in dependence upon the detected correlation; applying the gain adjustment to the given input digital audio signal to generate a respective gain-adjusted input digital audio signal; and combining the set of gain-adjusted input digital audio signals to generate an output digital audio signal.

15 Claims, 15 Drawing Sheets

(56) References Cited

U.S. PATENT DOCUMENTS

| | | | | |
|---|---|---|---|---|
| 2007/0019813 | A1* | 1/2007 | Hilpert | G10L 19/008 381/22 |
| 2008/0192946 | A1* | 8/2008 | Faller | H04M 9/082 381/66 |
| 2012/0243711 | A1* | 9/2012 | Fujita | H04R 3/005 381/119 |
| 2013/0272542 | A1 | 10/2013 | Tracey | |
| 2014/0330344 | A1* | 11/2014 | Mishra | H04R 25/30 607/57 |
| 2015/0030182 | A1 | 1/2015 | Goossens et al. | |
| 2016/0212561 | A1 | 7/2016 | Adami et al. | |
| 2016/0336014 | A1* | 11/2016 | Brockmole | H04S 3/008 |
| 2019/0045312 | A1* | 2/2019 | Gunawan | H04M 3/568 |

OTHER PUBLICATIONS

Aichinger, P., et al., "Describing the transparency of mixdowns: The Masked-to-Unmasked-Ratio," Audio Engineering Society, Convention Paper 8344, Presented at the 130th Convention, London, UK, May 13-16, 2011, pp. 1-10.

Bitzer, J., and Leboeuf, J., "Automatic detection of salient frequencies," Audio Engineering Society, Convention Paper 7704, Presented at the 126th Convention, Munich, Germany, May 7-10, 2009, pp. 1-6.

Dannenberg, R.B., "An Intelligent Multi-Track Audio Editor," In Proceedings of the 2007 International Computer Music Conference, vol. 2, San Francisco, Aug. 2007, pp. 1-7.

Deruty, E., and Tardieu, D., "About Dynamic Processing in Mainstream Music," Journal of the Audio Engineering Society, vol. 62, No. 1/2, Jan./Feb. 2014, pp. 42-55.

Deruty, E., et al., "Human-Made Rock Mixes Feature Tight Relations Between Spectrum and Loudness," Journal of the Audio Engineering Society, vol. 62, No. 10, Oct. 2014, pp. 1-11.

Deruty, E., "Goal-Oriented Mixing," Proceedings of the 2nd AES Workshop on Intelligent Music Production, London, UK, Sep. 13, 2016, 2 pages.

Fletcher, H., and Munson, W.A., "Loudness, Its Definition, Measurement and Calculation," The Journal of the Acoustical Society of America, vol. 5, No. 2, Oct. 1993, pp. 82-108.

Hafezi, S., and Reiss, J.D., "Autonomous Multitrack Equalization Based on Masking Reduction," Journal of the Audio Engineering Society, vol. 63, No. 5, May 2015, pp. 312-323.

"Acoustics—Normal equal-loudness-level contours," ISO 226, Aug. 15, 2003, 54 pages.

Ma, Z., et al., "Intelligent Multitrack Dynamic Range Compression," Journal of the Audio Engineering Society, vol. 63, No. 6, Jun. 2015, pp. 412-426.

Mansbridge, S., et al., "Implementation and Evaluation of Autonomous Multi-track Fader Control," Audio Engineering Society, Convention Paper 8588, Presented at the 132nd Convention, Budapest, Hungary, Apr. 26-29, 2012, pp. 1-11.

Qmul, "Automatic mixing tools for audio and music production," Center for Digital Music, Retrieved from the Internet URL: http://c4dm.eecs.qmul.ac.uk/automaticmixing/, 1 page.

Ma, Z., et al., "Partial Loudness in Multitrack Mixing," AES 53rd International Conference, London, UK, Jan. 27-29, 2014, pp. 1-9.

Ronan, D., et al., "Automatic Subgrouping of Multitrack Audio," Proc. of the 18th Int. Conference on Digital Audio Effects (DAFx-15), Trondheim, Norway, Nov. 30-Dec. 3, 2015, pp. 1-8.

Ronan, D., et al., "Analysis of the subgrouping practices of professional mix engineers," Audio Engineering Society, Convention Paper, Presented at the 142nd Convention, Berlin, Germany, May 20-23, 2017, pp. 1-13.

Stavrou, M., "Mixing with your Mind," 2008, 1 page.

Suzuki, Y., and Takeshima, H., "Equal-loudness-level contours for pure tones," The Journal of the Acoustical Society of America, vol. 116, No. 2, Aug. 2004, pp. 918-933.

Ward, D., et al., "Multi-track mixing using a model of loudness and partial loudness," Audio Engineering Society, Convention Paper 8693, Presented at the 133rd Convention, San Francisco, USA, Oct. 26-29, 2012, pp. 1-9.

Ward, D., and Reiss, J.D., "Loudness Algorithms for Automatic Mixing," Proceedings of the 2nd AES Workshop on Intelligent Music Production, London, UK, Sep. 13, 2016, 2 pages.

"REAPER | Audio Production Without Limits," Digital Audio Workstation, Retrieved from the Internet URL: http://www.reaper.fm/, on Oct. 4, 2017, 4 pages.

"Q10 Equalizer User Guide", WAVES, Q10 Paragraphic EQ/User Guide, Retrieved from the Internet URL: https://www.waves.com/1lib/pdf/plugins/q10-equalizer.pdf, 25 pages.

"WAVES InPhase User Guide," Retrieved from the Internet URL: https://www.waves.com/1lib/pdf/plugins/q10-equalizer.pdf, 21 pages.

"L2-UltraMaximizer Software audio processor User's Guide," Retrieved from the Internet URL: http://www.waves.com/plugins/l2-ultramaximizer, pp. 1-18.

"Up and Running: A REAPER User Guide v 6.03," Jan. 2020, pp. 1-432.

"Filtfilt," Zero-Phase digital filtering, Retrieved from the Internet URL: https://www.mathworks.com/help/signal/ref/filtfilt.html; 6 pages.

Smith III, O. J., "Zero-Phase Filters (Even Impulse Responses)," Introduction to Digital Filters With Audio Applications, CCRMA, Sep. 2007, 2 pages.

John, V., "Multi-Source Room Equalization: Reducing Room Resonances," Audio Engineering Society, Convention Paper 7262, Presented at the 123rd Convention, Oct. 1, 2007, 2 pages (with Abstract only).

* cited by examiner

AUDIO PROCESSING

CROSS-REFERENCE TO RELATED APPLICATIONS

The present application is based on PCT filing PCT/EP2018/077834, filed Oct. 12, 2018, which claims priority to EP 17196652.6, filed Oct. 16, 2017, the entire contents of each are incorporated herein by reference.

BACKGROUND

Field

This disclosure relates to audio processing.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, is neither expressly or impliedly admitted as prior art against the present disclosure.

It is known to mix digital audio signals or files to produce a mixed output signal. the correlation of pairs of input signals can have an enhancing or cancelling effect on the level of the summed signal.

Note that it can be common for sound engineers to use the term "phase" to refer to such an enhancing or cancelling relationship in this context. However, the relative "phase" of two files or signals is a useful concept only if the files are harmonic; whereas the phenomenon discussed here can be evidenced even if the files are not harmonic (for example in the case of two white noise signals with [white noise signal 1]=−1*[white noise signal 2].

SUMMARY

The present disclosure provides an audio processing method comprising:

for each given input digital audio signal of a set of two or more input digital audio signals, detecting a correlation between the given input digital audio signal and others of the input digital audio signals;

generating a gain adjustment for application to the given input digital audio signal in dependence upon the detected correlation;

applying the gain adjustment to the given input digital audio signal to generate a respective gain-adjusted input digital audio signal; and combining the set of gain-adjusted input digital audio signals to generate an output digital audio signal.

The present disclosure also provides audio processing apparatus to process a set of two or more input digital audio signals to generate an output digital audio signal, the apparatus comprising:

detector circuitry, for each given input digital audio signal of the set of two or more input digital audio signals, to detect a correlation between the given input digital audio signal and others of the input digital audio signals;

generator circuitry to generate a gain adjustment for application to the given input digital audio signal in dependence upon the detected correlation;

gain circuitry to apply the gain adjustment to the given input digital audio signal to generate a respective gain-adjusted input digital audio signal; and mixer circuitry to combine the set of gain-adjusted input digital audio signals to generate the output digital audio signal.

Respective further aspects and features of the present disclosure are defined in the appended claims.

It is to be understood that both the foregoing general description and the following detailed description are exemplary, but are not restrictive, of the present technology.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, in which.

DESCRIPTION OF THE PREFERRED EMBODIMENTS

Figure 1:
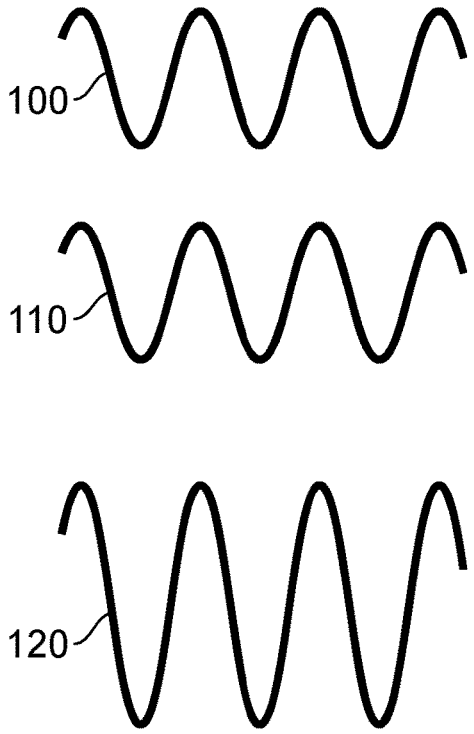
FIGS. 1 and 2 schematically illustrate the combination of digital audio signals in dependence upon their correlation.
Figure 2:
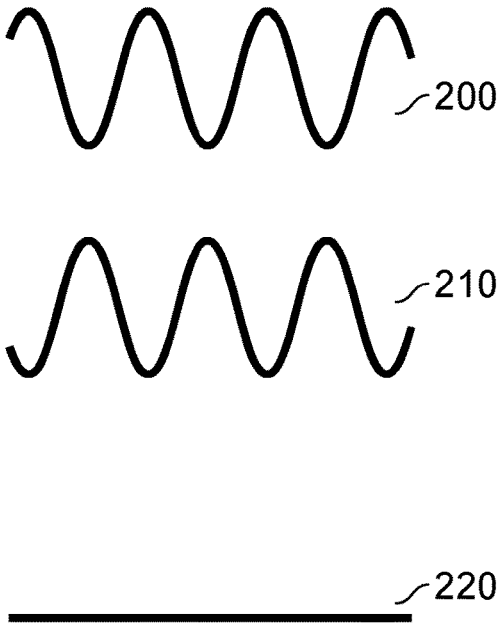

Referring now to the drawings, FIGS. 1 and 2 schematically illustrate the combination of digital audio signals in dependence upon their correlation.

FIG. 1 schematically illustrates a pair of input digital audio signals 100, 110. A sine wave signal is represented in each case, mainly for simplicity of the discussion. It can be seen that the two signals 100, 110 have a very high correlation with one another (and might, as discussed above, be referred to by sound engineers as being "in phase"). Correlation is typically expressed (and this is the form used here) as extending between +1 (highest positive correlation), via 0 (no correlation) to −1 (greatest negative correlation). The strong correlation implies that when they are added together, for example by a summing or mixing process to generate an output audio signal 120, the amplitude of the output audio signal 120 is twice that of the amplitude of either of the individual input digital audio signals 100, 110.

Another extreme example is shown in FIG. 2, in which input digital audio signals 200, 210 have a highly negative correlation. When they are summed together, the resulting output digital audio signal 220 has a zero amplitude.

In between these two extremes, an uncorrelated pair of signals added together will simply sum with no correlation-based enhancement or cancellation, or with intermediate correlations such as −0.6, −0.4, 0.6 or the like, exhibiting a partial enhancement or cancellation.

Figure 3:
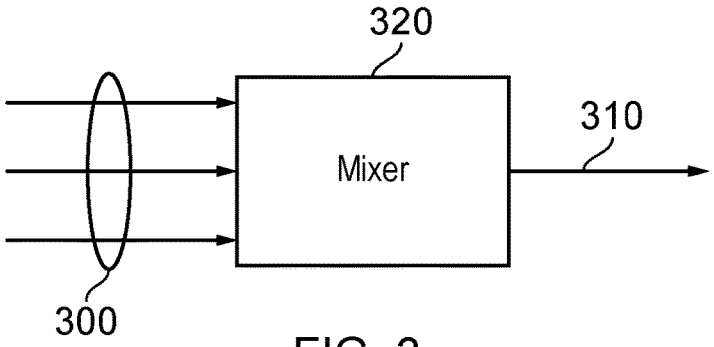
FIG. 3 schematically illustrates a digital audio mixer.

FIG. 3 schematically illustrates a digital audio mixer 320 which receives a set of input digital audio signals 300 and mixes them, for example by a summing process to generate an output digital audio signal 310. The type of mixer shown in FIG. 3 will encounter the problems discussed with reference to FIGS. 1 and 2, namely that the amplitude of the output digital audio signal 310 can be dependent upon the pair-wise correlation of the input signals 300.

Figure 4:
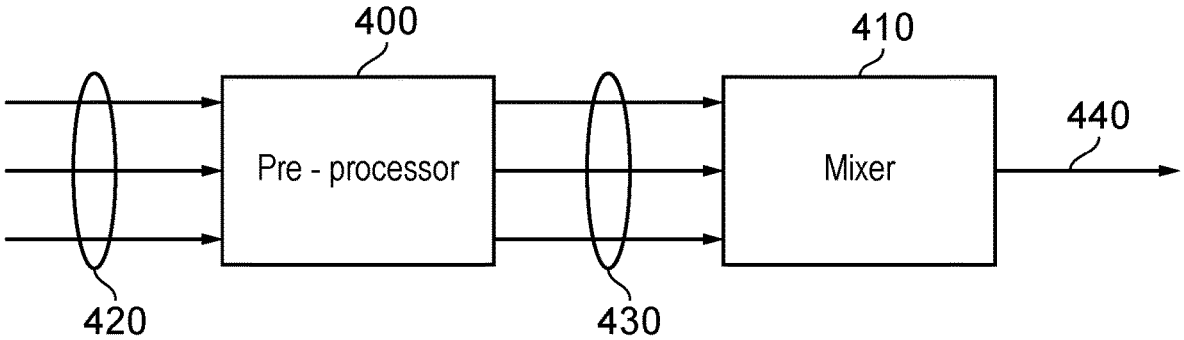
FIG. 4 schematically illustrates a digital audio processing apparatus.

As an overview of some of the techniques to be discussed below, FIG. 4 schematically illustrates a digital audio processing apparatus comprising a pre-processor 400 and a mixer 410. The pre-processor 400 receives a set 420 of input digital audio signals and generates a processed or gain-adjusted set 430 of signals which are mixed by the mixer 410 in a similar manner to the mixer 310 discussed above to generate the output digital audio signal 440. The pre-processor 400 uses properties of the input digital audio signals such as the correlation between the audio signals to modify the signals which are supplied to the mixer 410 so that the observed levels of the audio signals after summing is identical or near to their original levels as individual files. In the examples, the pre-processor performs steps of detecting a correlation and generating and applying a gain adjustment for the set of input digital audio signals before the mixer 410 combines the set of gain-adjusted input digital audio signals to generate an output digital audio signal.

Figure 5:
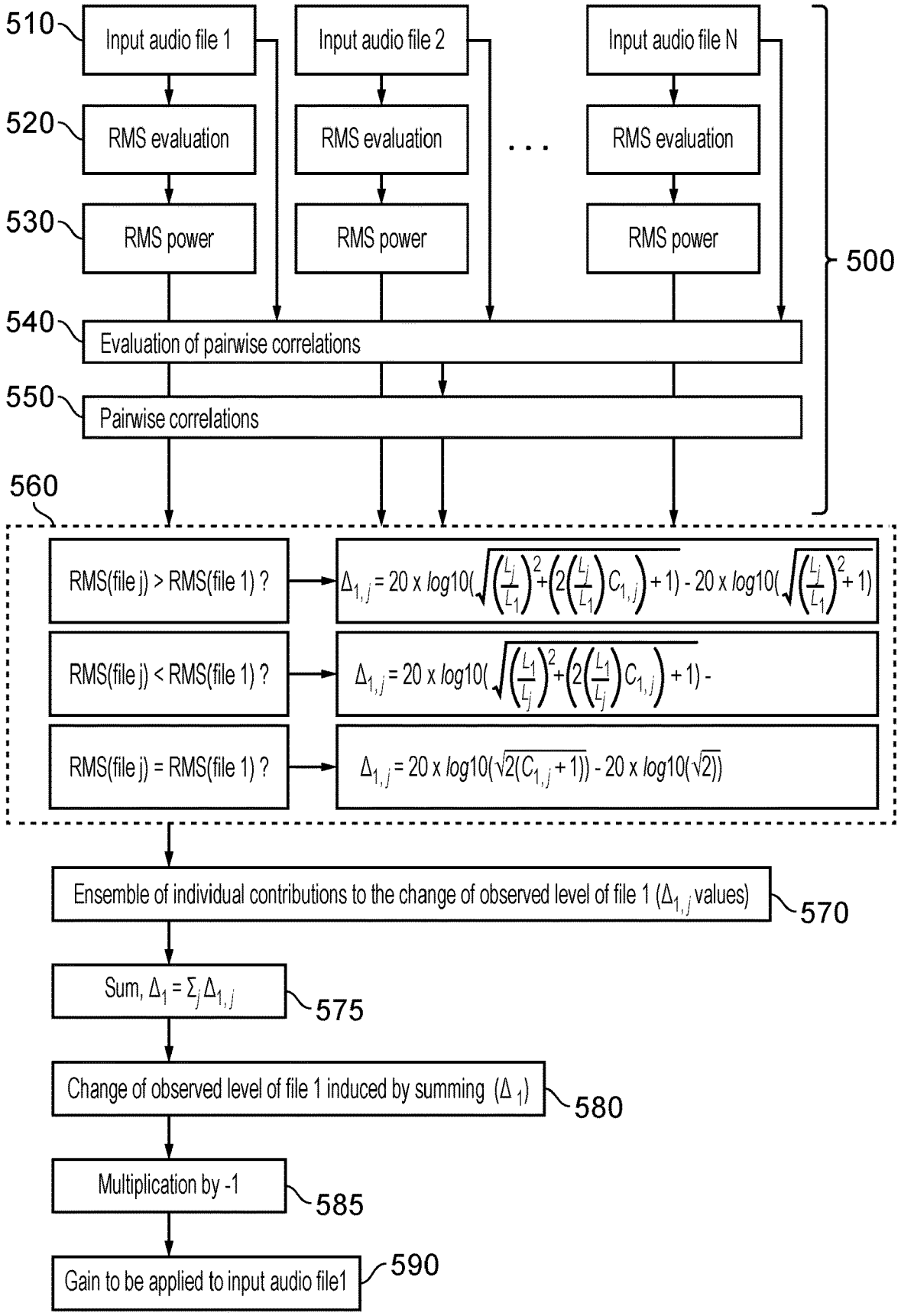
FIG. 5 is a schematic flowchart illustrating a method.

FIG. 5 is a schematic flow chart illustrating a method so as to provide an overview of the present techniques. An upper portion 500 of FIG. 5 relates to steps which are carried out for each input digital audio signal (referred to as an audio file) of a set of input digital audio signals. their operation for an arbitrary individual audio file (audio file 1) will be discussed in detail. A remaining portion of FIG. 5 relates to operations carried out for one example input digital audio signal (referred to as input audio file 1).

Referring to the upper portion 500, for an input digital audio signal such as the input audio file 1 510, at a step 520 the RMS (root mean square) power for that audio file is evaluated, providing an RMS power value 530 for the input audio file 1. Note that this evaluation may be carried out across the whole input audio file or on successive portions of the input audio file referred to as windows. The windows may have a length of 50 milliseconds (ms) up to, say, the length of the audio file.

At a step 540, pair-wise correlations between the input audio file 1 and each of the other input files taken individually are evaluated resulting in pair-wise correlation data 550, again across the entire file or on a windowed basis. An example pair-wise correlation with an arbitrary other file, file j, will be considered in detail but (subject to considerations discussed below) the pair-wise correlation is performed with each other file. The step 540 therefore provides an example of detecting pair-wise correlations between the given input digital audio signal and respective ones of the others of the input digital audio signals.

At a step 560, the power values 530 and the pair-wise correlations 550 with file j are processed according to the following set of equations:

Let $\vec{X}_1$ and $\vec{X}_J$ be two mono audio files of length N.

Let $L_1$ be the root-mean square of $\vec{X}_1$, with $$L_1 = \sqrt{\frac{1}{N}\sum_n \left(\vec{X_1}[n]^2\right)}.$$

Let $L_j$ be the root-mean square of $\vec{X}_J$, with $$L_j = \sqrt{\frac{1}{N}\sum_n \left(\vec{X_J}[n]^2\right)}.$$

As a convention, suppose $L_1 \leq L_j$. If it's not the case, we switch $L_1$ and $L_j$ in the equations.

Let $L_{1+j}$ be the root-mean square of $\vec{X}_1+\vec{X}_2$, with $$L_{1+j} = \sqrt{\frac{1}{N}\sum_n \left(\left(\vec{X_1}[n] + \vec{X_J}[n]\right)^2\right)}.$$

Let $C_{1,j}$ be the linear correlation between $\vec{X}_1$ and $\vec{X}_J$. Then:

$$L_{1+j} = L_1\sqrt{\left(\frac{L_j}{L_1}\right)^2 + \left(2\left(\frac{L_j}{L_1}\right)C_{1,j}\right) + 1}.$$

In particular, when $L_1=L_j$, $L_{1+j}=L_1\sqrt{2(C_{1,j}+1)}$.

Therefore, for each $\vec{X}_i$ and each $\vec{X}_J$, the level of the sum $L_{i+j}$ can be written as:

$$L_{i+j} = L_i\sqrt{\left(\frac{L_j}{L_i}\right)^2 + \left(2\left(\frac{L_j}{L_i}\right)C_{i,j}\right) + 1} \text{ if } L_i > L_j$$

$$L_{i+j} = L_j\sqrt{\left(\frac{L_i}{L_j}\right)^2 + \left(2\left(\frac{L_i}{L_j}\right)C_{i,j}\right) + 1} \text{ if } L_i < L_j$$

$$L_{i+j} = L_i\sqrt{2(C_{i,j}+1)} \text{ if } L_i = L_j.$$

Therefore, $$\frac{L_{i+j}}{L_i} = \sqrt{\left(\frac{L_j}{L_i}\right)^2 + \left(2\left(\frac{L_j}{L_i}\right)C_{i,j}\right) + 1} \text{ if } L_i > L_j \tag{6}$$

$$\frac{L_{i+j}}{L_j} = \sqrt{\left(\frac{L_i}{L_j}\right)^2 + \left(2\left(\frac{L_i}{L_j}\right)C_{i,j}\right) + 1} \text{ if } L_i < L_j$$

-continued $$\frac{L_{i+j}}{L_i} = \sqrt{2(C_{i,j}+1)} \text{ if } L_i = L_j.$$

Or, in logarithmic scale, $$20\log10(L_{i+j}) - 20\log10(L_i) = 20\log10\left(\sqrt{\left(\frac{L_j}{L_i}\right)^2 + \left(2\left(\frac{L_j}{L_i}\right)C_{i,j}\right) + 1}\right) \text{ if } L_i > L_j$$

$$20\log10(L_{i+j}) - 20\log10(L_j) = 20\log10\left(\sqrt{\left(\frac{L_i}{L_j}\right)^2 + \left(2\left(\frac{L_i}{L_j}\right)C_{i,j}\right) + 1}\right) \text{ if } L_i < L_j$$

$$20\log10(L_{i+j}) - 20\log10(L_i) = 20\log10\left(\sqrt{2(C_{i,j}+1)}\right) \text{ if } L_i = L_j.$$

From each $\vec{X}_i$, the corresponding $L_i$ is considered as not modified by the summing with $\vec{X}_J$ if the files are not correlated to each other, i.e. if $C_{i,j}=0$.

Therefore, if we write as $\Delta_{i,j}$ the logarithmic gain brought by $\vec{X}_J$ on $\vec{X}_J$, then:

$$\Delta_{i,j} = 20\times\log10\left(\sqrt{\left(\frac{L_j}{L_i}\right)^2 + \left(2\left(\frac{L_j}{L_i}\right)C_{i,j}\right) + 1}\right) - 20\times\log10\left(\sqrt{\left(\frac{L_j}{L_i}\right)^2 + 1}\right) \text{ if } L_i > L_j.$$

$$\Delta_{i,j} = 20\times\log10\left(\sqrt{\left(\frac{L_i}{L_j}\right)^2 + \left(2\left(\frac{L_i}{L_j}\right)C_{i,j}\right) + 1}\right) - 20\times\log10\left(\sqrt{\left(\frac{L_i}{L_j}\right)^2 + 1}\right) \text{ if } L_i < L_j.$$

$$\Delta_{i,j} = 20\times\log10\left(\sqrt{2(C_{i,j}+1)}\right) - 20\times\log10\left(\sqrt{2}\right) \text{ if } L_i = L_j.$$

$\Delta_{i,j}$ is expressed in *dB*.

So, the step 560 represents the three possible outcomes, namely that the RMS power for file j is greater than that of file 1, that it is the same as that of file 1, or that it is less than that of file 1.

This process results in a collection or ensemble of individual contributions to the change of observed level of the file 1 from each other file j at a step 570. At a step 575, these individual contributions are summed to produce a summed change of observed level of file 1 580 in response to all of the other files (all values of j).

Here is a worked example for two files 1,2 (that is to say, j=2):

Suppose, as an example, that $L_1=0.5$ and $L_2=0.4$.

On a logarithmic scale, $L_1=-6$ dB FS and $L_2=-8$ dB FS.

If the files are not correlated, i.e. $C_{1,2}=0$, then $L_{1+2}=0.64$, on a log. scale $L_{1+2}=-3.9$ dB FS.

If the files are correlated, i.e. for instance $C_{1,2}=0.8$, then $L_{1+2}=0.84$, on a log. scale $L_{1+2}=-1.4$ dB FS.

If $C_{1,2}=0.8$, then the sum of the files is played ca. 2.5 dB louder than if $C_{1,2}=0$, which is equivalent to stating that each file will (in the absence of the correction techniques discussed here) be played about 2.5 dB louder.

At a step 585 this change in observed level is negated, which is to say multiplied by −1, to generate a gain value 590 to be applied to the input audio file 1. The pre-processor 400 applies the gain adjustment. In other words, the predicted enhancement or cancellation is negated so as to be applied as a gain adjustment to undo the effect of the correlation-induced enhancement or cancellation.

Therefore, the steps 560-585 can provide an example of detecting (560-580) a degree of enhancement or cancellation of the given input digital audio signal which would result from the detected correlation on mixing with the others of the input digital audio signals; and deriving (585) the gain adjustment so as to at least partially compensate for the enhancement or cancellation. For example, with regard to the step 585, this can be an example of the deriving step comprising deriving the gain adjustment so as to (fully) compensate for the enhancement or cancellation, for example in situations other than when the correlation is exactly −1.

The steps discussed above are described in respect of one input audio file, but it will be appreciated that (subject to optional techniques for excluding some audio files) the techniques are carried out for each of the input digital audio signals.

Figure 6:
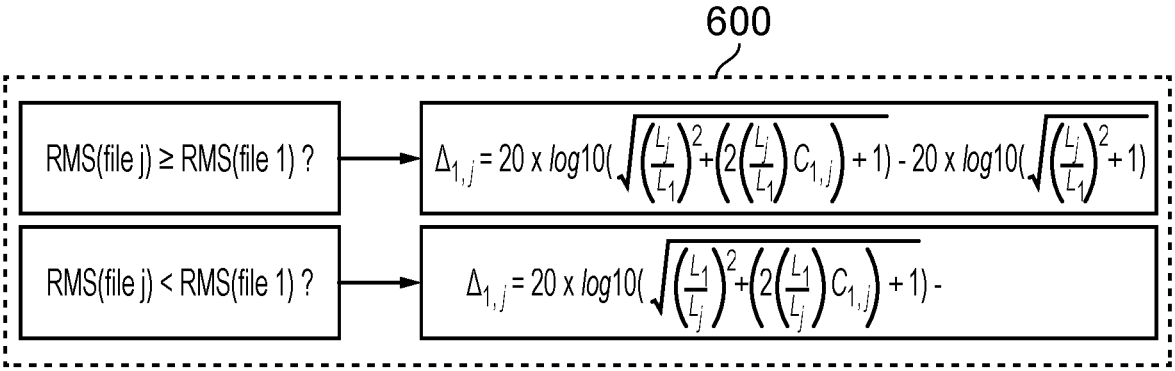
FIG. 6 schematically illustrates a variation of the flowchart of FIG. 5.

FIG. 6 schematically illustrates a variation of the flow chart of FIG. 5, in particular the use of the following pair of situations:

RMS power (file j) is greater than or equal to that of file 1;

RMS power (file j) is less than that of file 1

These equations, embodied as a step 600 to be used in place of the step 560 of FIG. 5, recognise that if the two RMS powers are equal, the final equation of the step 560 becomes merely a special case of the first equation. So, rather than the first equation of 560 occurring when the RMS power of file j is greater than the RMS power of file 1, this inequality is now changed to a "greater than or equal to" inequality.

Figure 7:
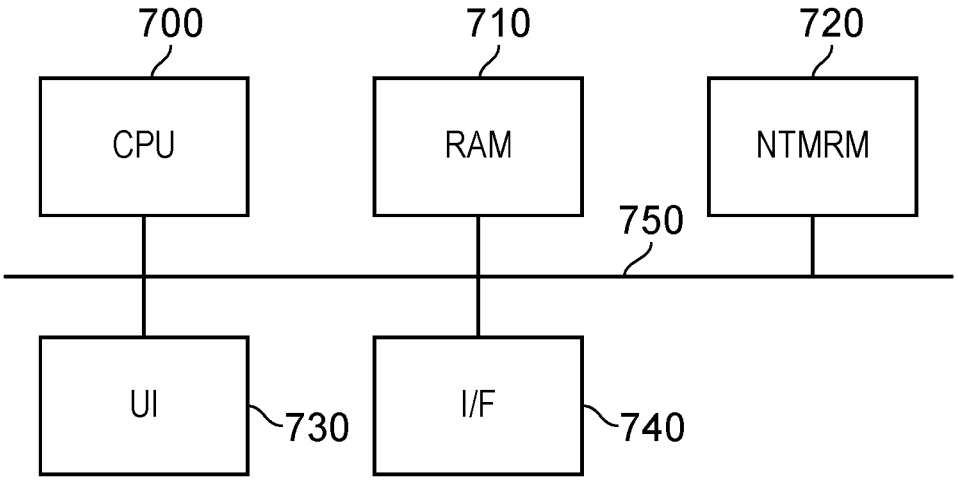
FIG. 7 schematically illustrates data processing apparatus.

FIG. 7 schematically illustrates a data processing apparatus suitable to carry out the methods discussed above, comprising a central processing unit or CPU 700, a random access memory (RAM) 710, a non-transitory machine-readable memory (NTMRM) 1820 such as a flash memory, a hard disc drive or the like, a user interface such as a display, keyboard, mouse, or the like 730, and an input/output interface 740. These components are linked together by a bus structure 750. The CPU 700 can perform any of the above methods under the control of program instructions stored in the RAM 710 and/or the NTMRM 720. The NTMRM 720 therefore provides an example of a non-transitory machine-readable medium which stores computer software by which the CPU 700 perform the method or methods discussed above.

Various examples will now be discussed in connection with FIGS. 8 to 11. The examples relate to a non-windowed arrangement so that each input signal or file is associated In each of these examples, 16 input signals are considered, numbered 1-16. The pair-wise correlations are shown in each case by an array 800 of correlation values between a signal on the horizontal axis and a signal on the vertical axis. It will be seen that values on the leading diagonal (lower left to upper right) are 1.0, as this represents the correlation (which does not have to be detected) between a signal and itself. Other values are symmetrical about the leading diagonal and need be detected only once for each pair (for example, the correlation between the signals 5 and 1 is the same as the correlation between the signals 1 and 5).

Figure 8:
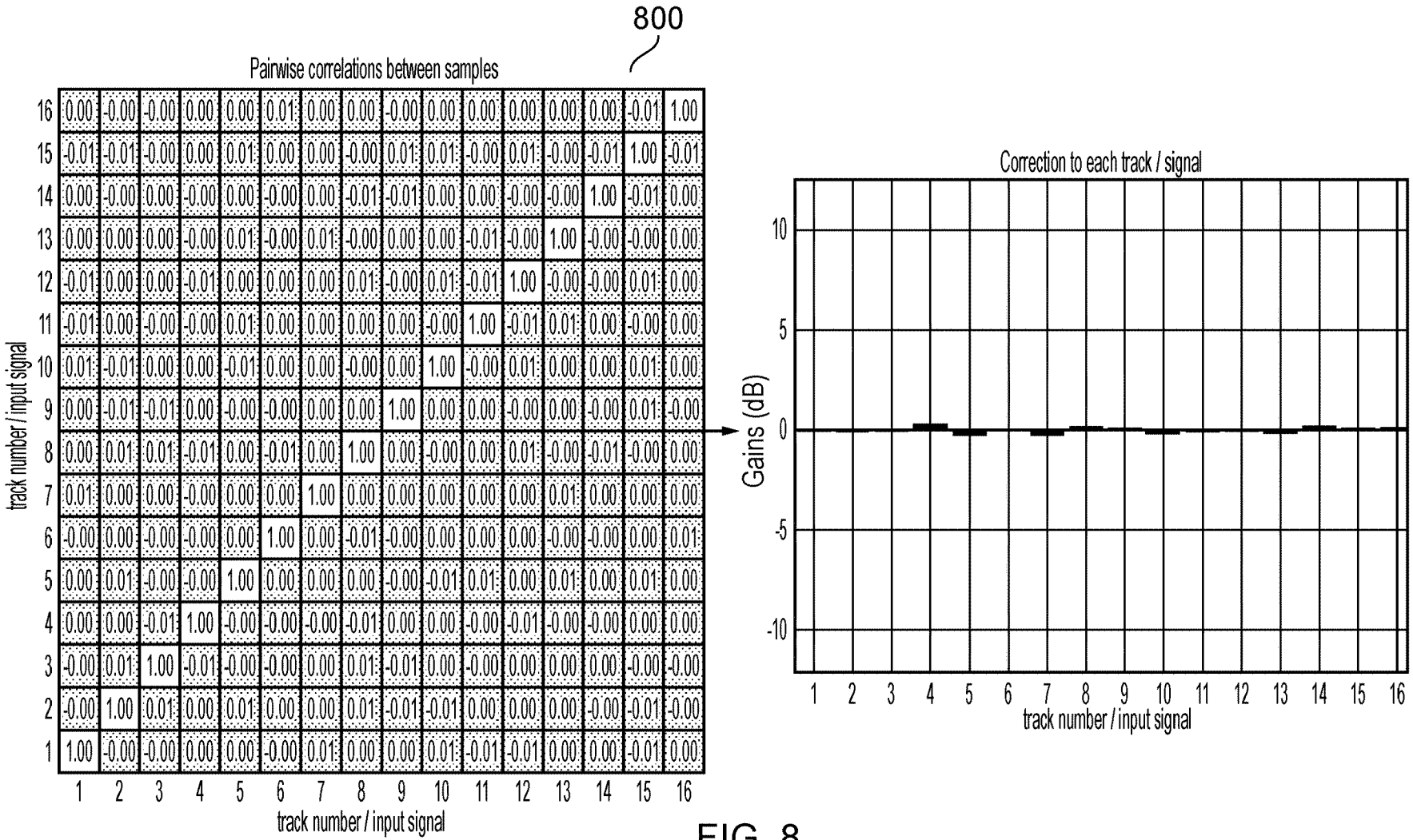
FIGS. 8 to 11 schematically illustrate respective example correlation scenarios.

To the right-hand side of FIG. 8 as drawn is a graphical representation of the gain adjustment or correction applied to each signal, as measured in decibels (dB), resulting from these correlations.

In FIG. 8, all the audio files have the same level and are almost entirely uncorrelated. The gains for all audio files prior to summing are therefore close to zero. In common with FIGS. 9-11, correlations which are zero (or trivially close to zero) are shown shaded, whereas correlations which are other than being trivially close to zero are drawn unshaded.

Figure 9:
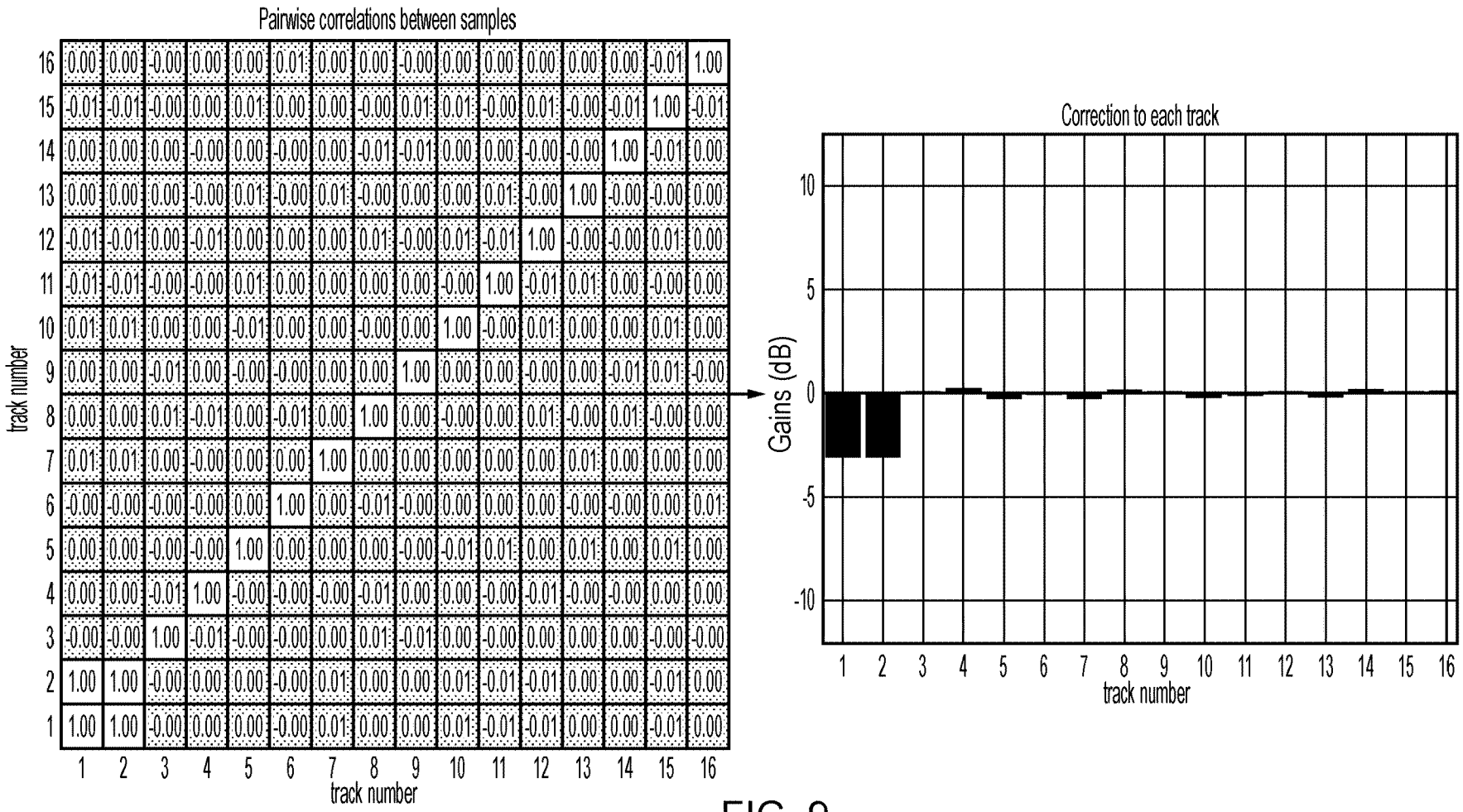

In FIG. 9, all the audio files have the same level, and two audio files (1, 2) are correlated. From the point of view of file 1, file 2 is the only file that contributes to the changing of its observed level induced by summing. The contribution of file 2 is provided by the equations above, with $\Delta_{1,2}=20\times\log 10(\sqrt{4})-20\times\log 10(\sqrt{2}))=3$ dB. The gain to be applied to file 1 before summing is therefore −3 dB. The same process can be described from the point of view of file 2, with the gains applied to file 2 before summing being also −3 dB. If files 1 and 2 were of different level, then the absolute value of the gains would be less. For instance, if $L_2=0.5L_1$, then according to the equations defined above, the gains to be applied to files 1 and 2 would be −1.6 dB.

Figure 10:
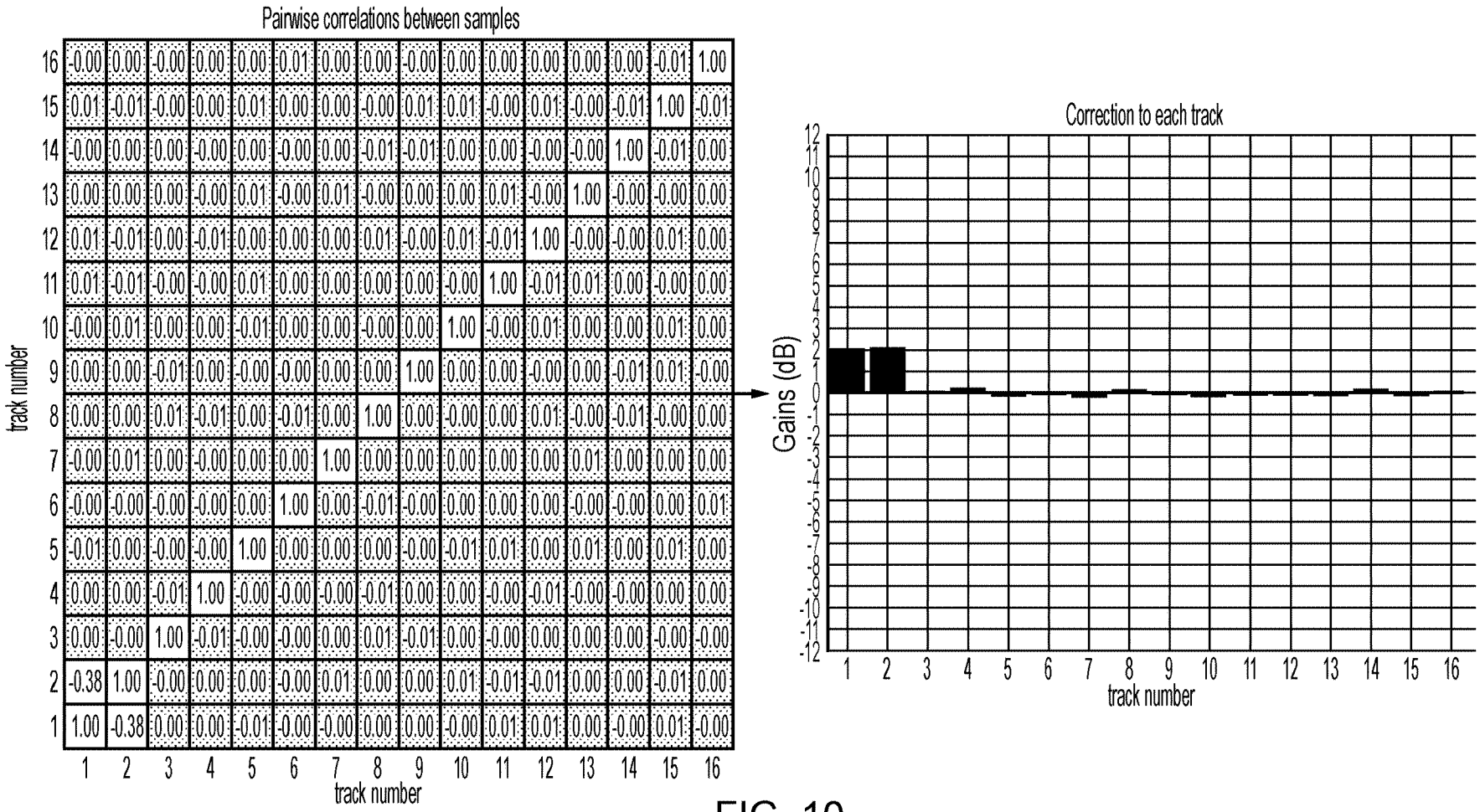

In FIG. 10, all the audio files have the same level, and the correlation between files 1 and 2 is negative (−0.38). From the point of view of file 1, file 2 is the only file that contributes to the changing of its observed level induced by summing. The contribution of file 2 is provided by the equations above, with $\Delta_{1,2}=-2.1$ dB. Accordingly, the gain to be applied to file 1 before summing is +2.1 dB. The same process can be described from the point of view of file 2. The difference in gains that can be observed between file 1 and 2 is the result of residual correlations between file 2 and files 3 to 12. This example reflects a common situation in audio and music mixing, where phase problems decrease the observed level of audio files after summing. The process described in the present application can compensate for such correlation-based problems.

Figure 11:
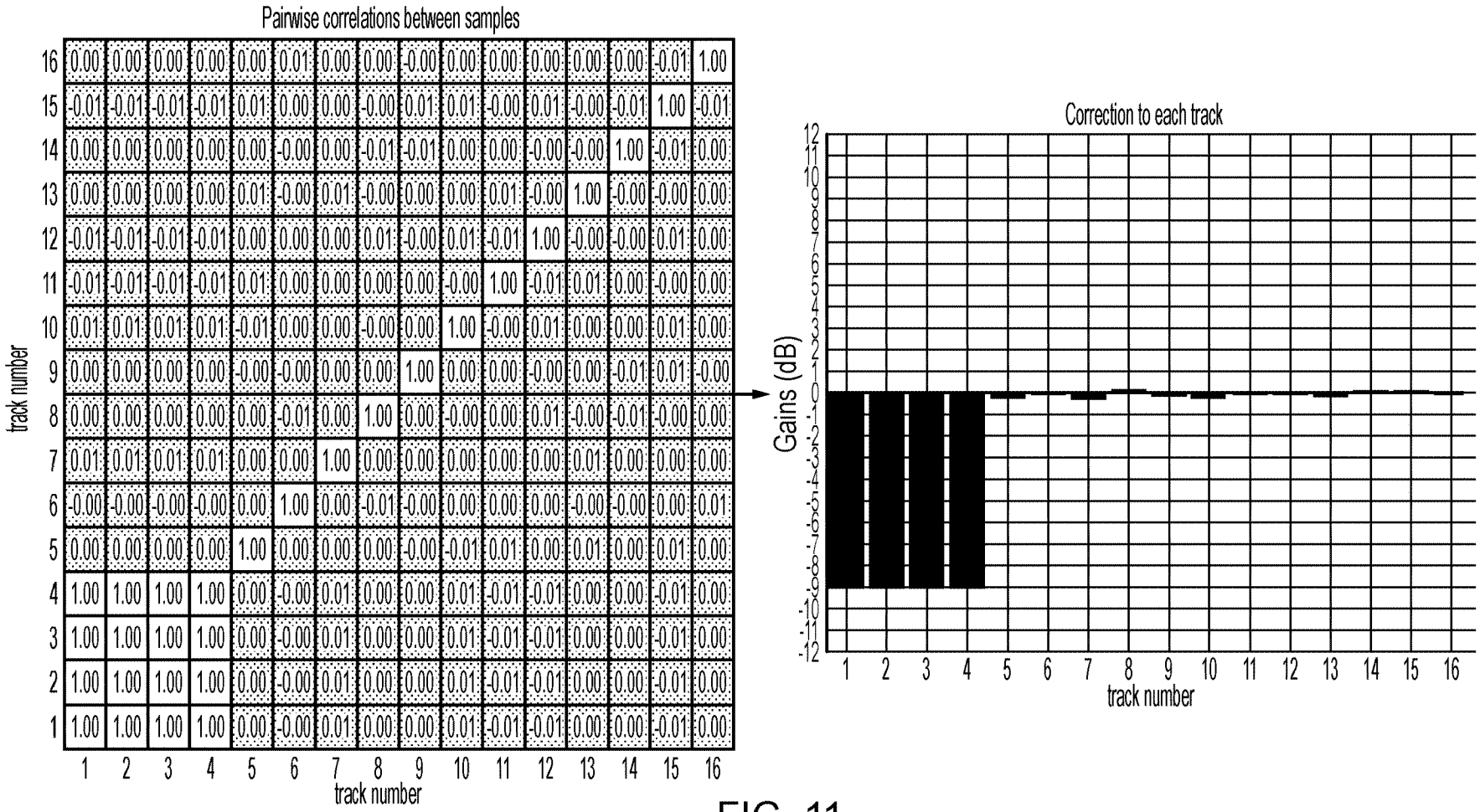

In FIG. 11, all the audio files have the same level, and four audio files are correlated. From the point of view of file 1, files 2, 3 and 4 contribute to the changing of its observed level induced by summing. According to the equations above, each individual contribution is 3 dB. From the point of view of file 1, the combined contribution on all other files is 9 dB. The gains to be applied to file 1 before summing is therefore −9 dB. The same process can be described from the point of view of files 2, 3 and 4, with the gains applied to each file before summing being also −9 dB.

Figure 12:
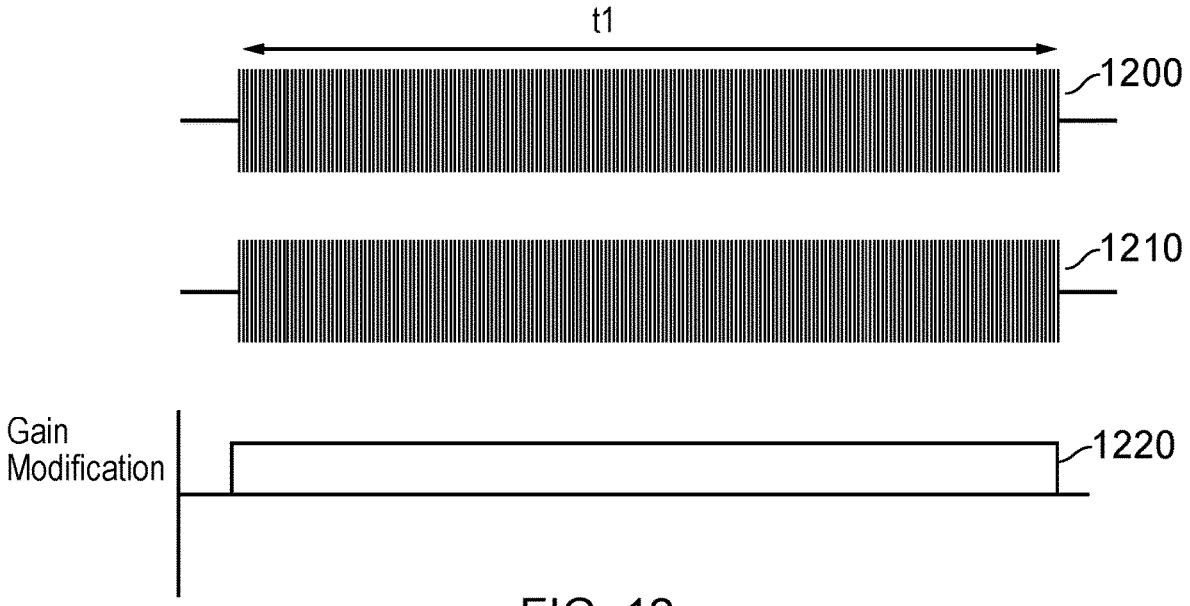
FIG. 12 schematically illustrates a measure of correlation between two input audio signals.

FIG. 12 schematically illustrates a measure of correlation between two input digital audio signals 1200, 1210. The signals are represented as having a length in time of t1, which in this example is the same for both input digital audio signals. (Note that if, in an example situation, one digital audio signal was shorter than the other, the process would simply be carried out for the overlap period, since that is the only period for which the correlation between the signals can have an effect on the perceived output level).

In the example of FIG. 12, the processing discussed above is carried out for the entire length of the input digital audio signals, which is to say that in this example a windowing process dividing the input digital audio signals into portions as mentioned above is not performed, giving rise to a single gain modification value 1220 applicable to the entirety of the overlap period of the digital audio signals.

Figure 13:
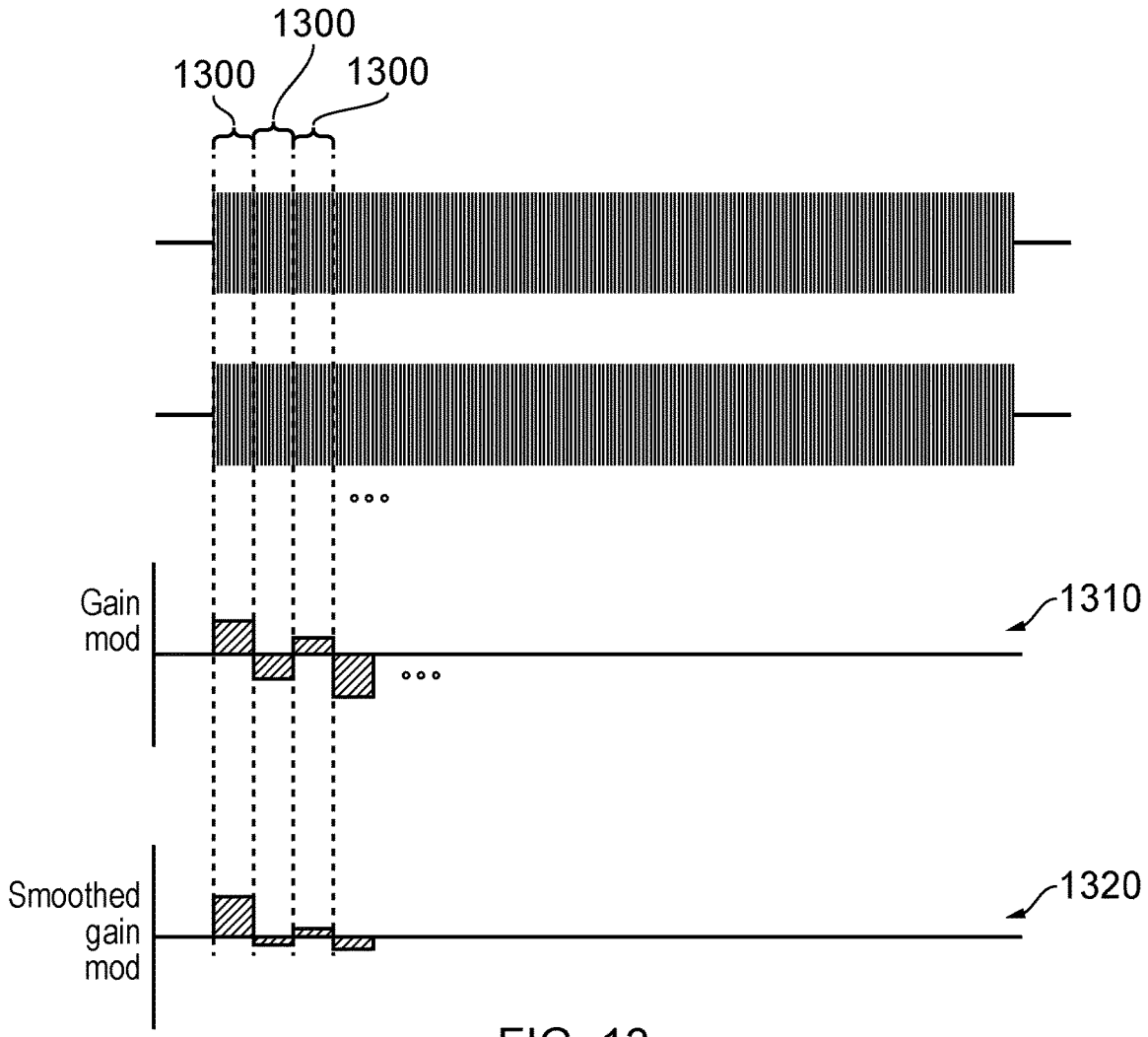
FIG. 13 schematically illustrates a windowed correlation.

In FIG. 13, a windowing process is used in which the digital audio signals are considered as multiple successive windows or portions 1300, for example portions of the same length in time. This gives rise to the generation of a respective gain modification value 1310, one value for each window or portion. To avoid subjective disturbance caused by abrupt changes in gain of any of the signals, the gain modifications 1310 can be smoothed or low-pass filtered in time to give smoothed gain modification values 1320.

These two options are discussed with reference to FIGS. 14 and 15 which are schematic flow charts illustrating respective methods according to the techniques discussed with reference to FIGS. 5 and 6. A summary of some stages of those techniques is included in FIGS. 14 and 15

Figure 14:
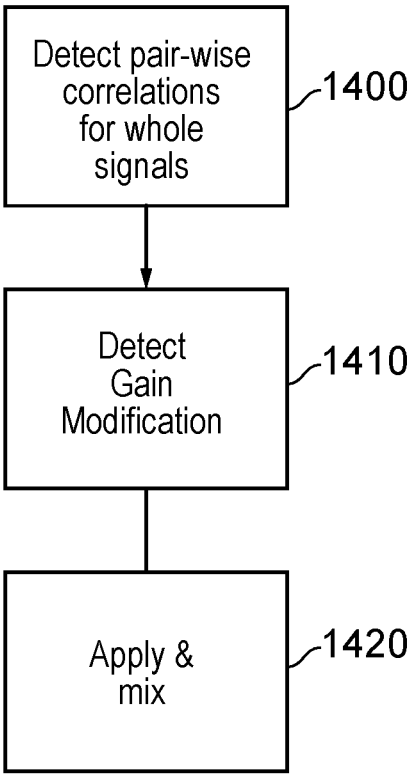
FIGS. 14 and 15 are schematic flowcharts illustrating respective methods.

Referring to FIG. 14, at a step 1400, pair-wise correlations are derived for pairs of signals over the whole length of the input audio signals such as the signals 1200, 1210 of FIG. 12. At a step 1410 a gain modification value such as the value 1220 is derived from the correlations applicable to each input signal and applies to the whole length of that signal amongst the signals to be mixed. At a step 1420 each gain modification is applied and the signals are mixed.

Figure 15:
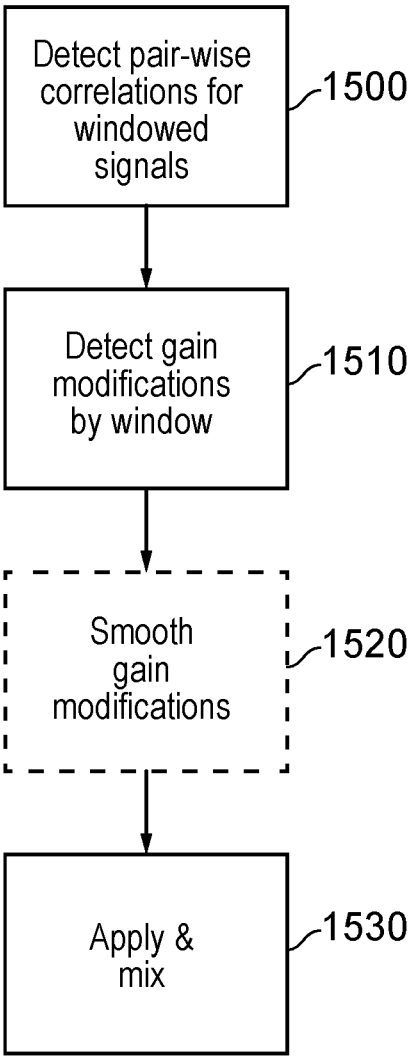

In FIG. 15, and referring to FIG. 13, pair-wise correlations are derived for the windowed input signals at a step 1500, leading to the generation of window-by-window gain modification values. At a step 1510, such gain modification values 1310 are derived for each window for a current one of the input signals. At an optional step 1520, the gain modifications are smoothed or low-pass filtered in time, and at a step 1530 the (optionally smoothed) gain modifications are applied to the signals and the mixing process is performed. For example, the filtering can be performed with a so-called zero-phase low-pass digital filter, for example with a time constant of (say) ten seconds), for example as discussed in: https://ccrma.stanford.edu/~jos/fp/Zero_Phase_Filters_Even_Impulse.html Such a filter can be implemented in the Matlab™ software, for example using the techniques and command structure discussed in: https://fr.mathworks.com/help/signal/ref/filtfilt.html These two references are incorporated in the present description by reference.

In the example of FIG. 15, a step of detecting a correlation comprises detecting (1500) a portion or window correlation applicable to successive portions of the given input digital audio signal; and the step of generating a gain adjustment comprises generating (1510) a respective portion gain adjustment for application to each portion of the given input digital audio signal in dependence upon the detected portion correlation.

In examples, each successive portion or window represents at least ten seconds of the input digital audio signal.

The smoothing represented by the step 1520 can be applied to the correlations and/or to the gain adjustments (by reordering the step 1520 to between the steps 1500, 1510), so that the step 1520 can represent an example of smoothing one or both of the detected portion correlations; and the generated portion gain adjustments; with respect to time for the given input digital audio signal.

In the arrangements as discussed above, the number of pair-wise correlations required for implementation of the system increases generally as the square of the number of digital input audio signals to be mixed. In some situations, such as situations in which the number of input signals is large (for example, over 10 input signals), this can lead to heavy processing requirements to provide the correlation processing. To arm to alleviate (at least in part) this potential problem, in example arrangements such as that described with reference to FIG. 16, some of this processing can be avoided or reduced by selectively excluding one or more pairs of the input digital audio signals from the detection of pair-wise correlation. An example of how this can be achieved will now be described.

Figure 16:
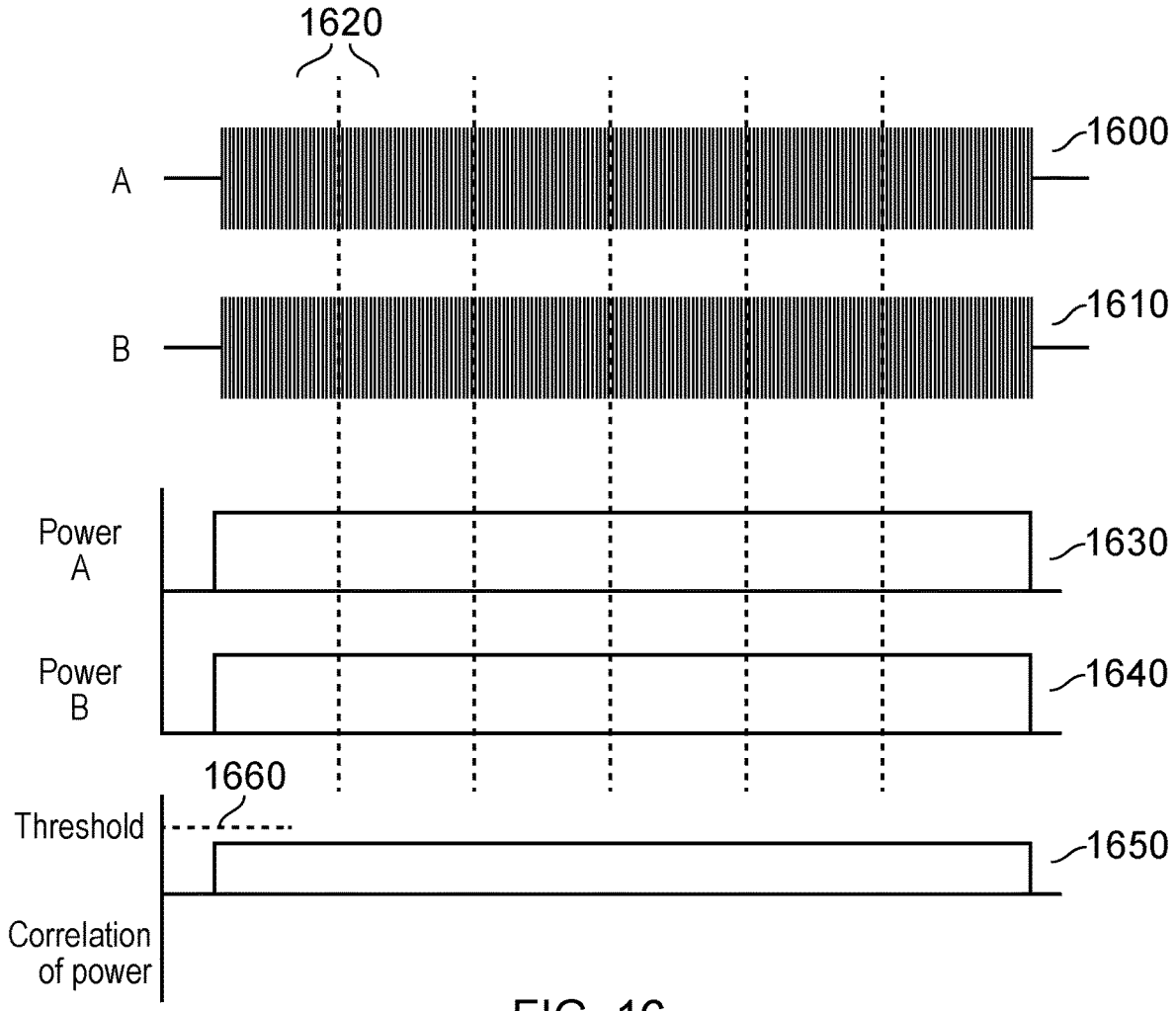
FIG. 16 schematically illustrates windowed power correlation.

Referring to FIG. 16, a pair of input digital audio signals 1600 (A), 1610 (B) (being a pair which would be subjected to the correlation processing discussed above as part of the pair-wise processing) are partitioned into windows or portions 1620 of, for example, 10 seconds of audio each.

From each of these portions, a respective RMS power value 1630, 1640 is derived and a correlation 1650 is detected between the RMS power values. If there is a relatively low correlation, for example the magnitude of the correlation 1650 is less than a correlation threshold 1660, then the pair can be excluded from the pair-wise sample-based correlation. Otherwise, the process proceeds as before for the pair.

Figure 17:
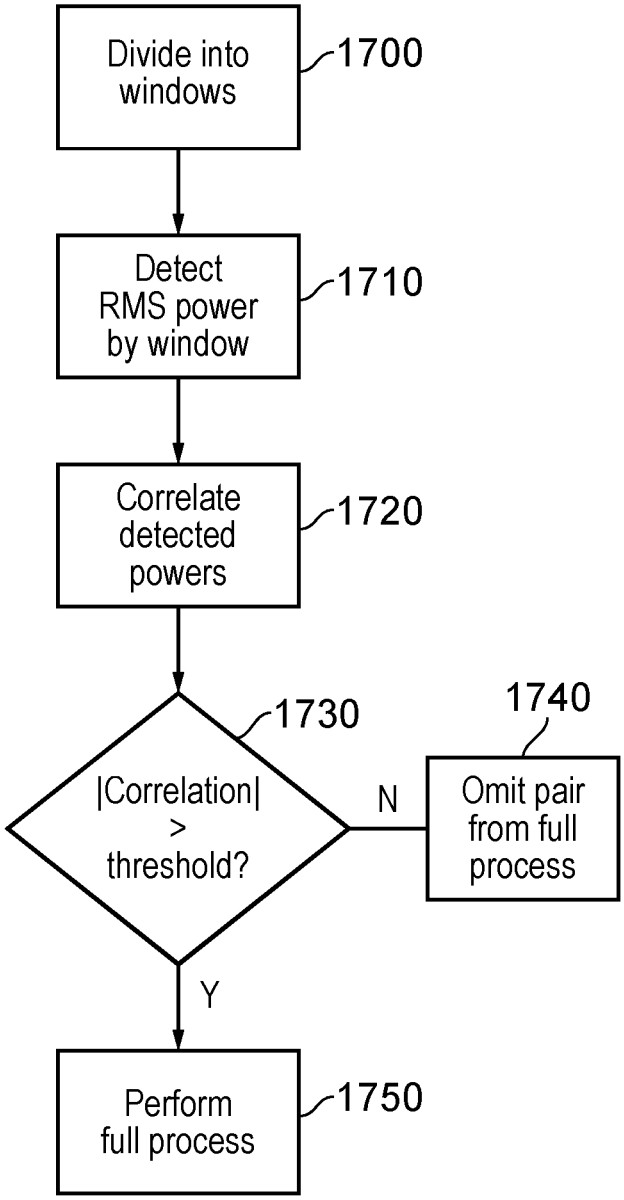
FIG. 17 is a schematic flowchart illustrating a method.

FIG. 17 is a schematic flow chart representing this method, in which, at a step 1700 a pair of input digital audio signals under test are divided into windows and at a step 1710 the RMS power 1630, 1640 for each window is derived. At a step 1720 the RMS power profiles are correlated and at a step 1730 the correlation value 1650 is compared with a threshold. The test applied at the step 1730 is in fact whether the magnitude or absolute value of the detected correlation is greater than a threshold, which is to say either the detected correlation value 1650 is very positive or very negative. If the outcome at the step 1730 is no, then control passes to a step 1740 where that particular pair is omitted or excluded from the full process involving sample based correlation detection. Otherwise, control passes to a step 1750 at which the pair is included within the full processing discussed above.

The steps 1700-1730 therefore provide an example of applying a predetermined test (such as a test of RMS power correlation) to pairs of the input digital audio signals; and the step 1740 provides an example of selectively excluding one or more pairs of the input digital audio signals from the detection of pair-wise correlation in dependence upon the result of the predetermined test. In example arrangements, the applying of the predetermined test involves detecting (1710) respective sequences of signal power values for successive windows of a pair of input digital audio signals; detecting (1720) the power correlation of the sequences of signal power values; and comparing (1730) the detected power correlation with a threshold correlation; and in which the step of selectively excluding comprises excluding (1740) a pair of the input digital audio signals from the detection of pair-wise correlation when the detected power correlation is less than the threshold correlation Another technique for potentially reducing the number of pair-wise correlations required will now be described. This can be performed instead of, or in addition to, the technique discussed in connection with FIGS. 16 and 17.

Figure 18:
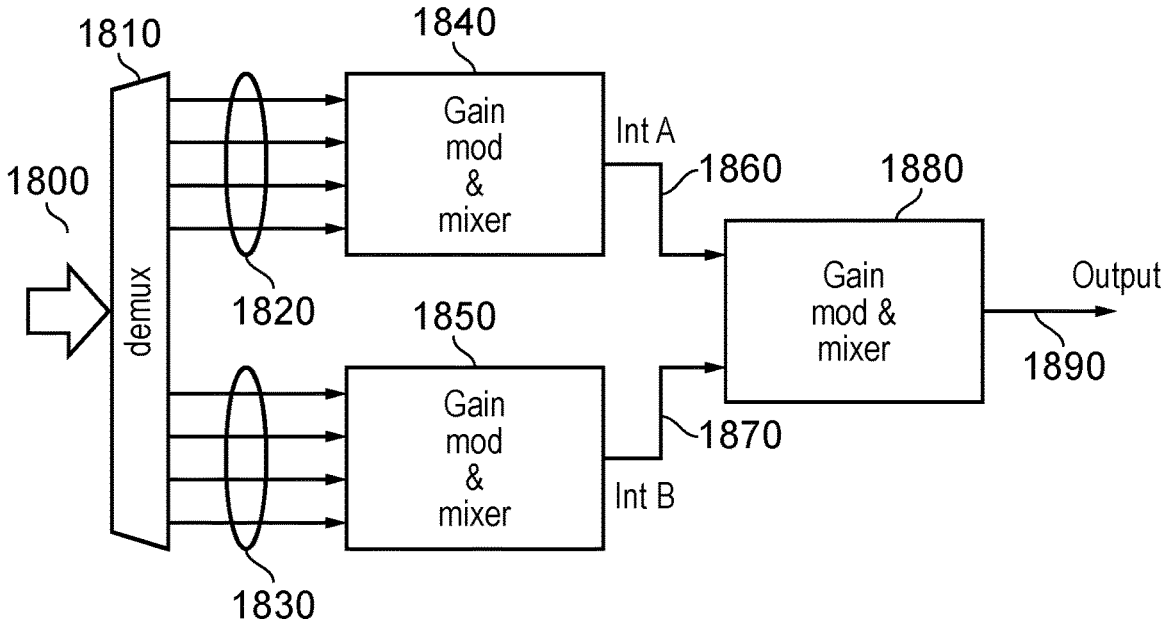
FIG. 18 schematically illustrates an audio processing apparatus.

FIG. 18 schematically illustrates an arrangement in which a set 1800 of digital audio signals is split or partitioned, for example by a demultiplexer 1810, into two or more groups 1820, 1830. For each group, the process discussed above with respect to FIGS. 5 and 6 is performed, by a block 1840, 1850 representing the gain modification and mixing process discussed above. This generates a pair of intermediate digital audio signals 1860, 1870 (or, more generally, one intermediate digital audio signal for each such group) which are then subjected to the gain modification and mixing process by a block 1880 to generate an output digital audio signal 1890.

By partitioning the input signals into groups, the number of pair-wise correlations can be reduced. For example, a set of 10 input signals requires 45 pair-wise correlations in the system discussed above. By partitioning into two groups of 5 signals, each group requires 10 pair-wise correlations, then the two intermediate signals require one correlation, so the total is reduced to 21 instances of the correlation process.

Note that in other examples more than two groups can be used, and more than two generations of intermediate signals may be used (for example, splitting a set of 200 input signals into ten groups of 20 input signals to generate ten intermediate signals, then splitting the ten intermediate signals into two groups of five, to generate two second-generation intermediate signals, then processing those as discussed above.

FIG. 18 therefore provides an example of partitioning the set of input digital audio signals into two or more groups of input digital audio signals; for each group of input digital audio signals, performing the detecting, generating, applying and combining steps to generate a respective intermediate digital audio signal; and for the two or more intermediate digital audio signals, performing the detecting, generating, applying and combining steps to generate the output digital audio signal.

With reference to the windowed arrangements discussed above, in some examples the window length can be adaptively changed, for example by deriving a portion or window length for the successive portions so as to provide less than a threshold variation of the generated portion gain adjustments with respect to time.

Figure 19:
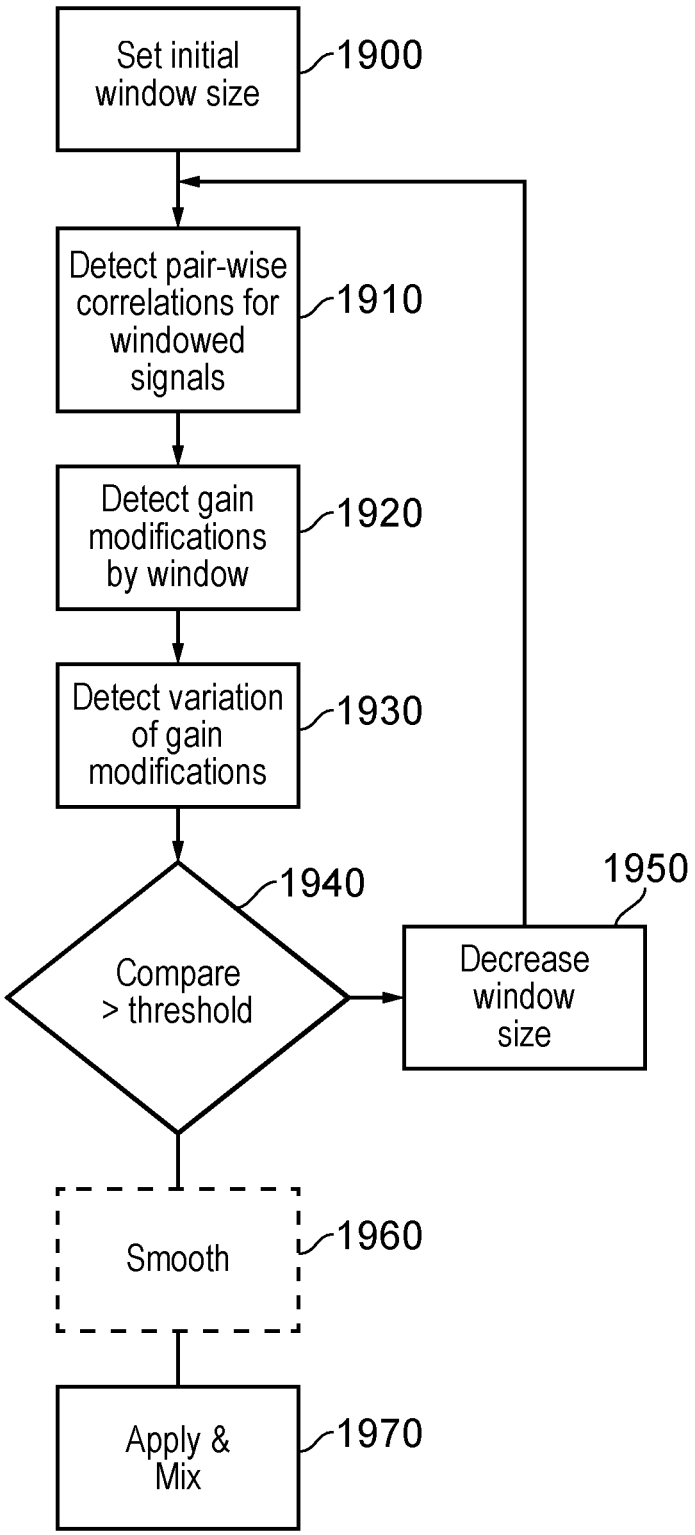
FIG. 19 schematically illustrates a window size setting method.

Referring to FIG. 19, at a step 1900, an initial window size of, for example, ten seconds is established. A step 1910 involves the detection of pair-wise correlation values for the windowed signals using that windows size, and a step 1920 involves detecting gain modifications, one gain modification value for each window.

At a step 1930, the variation of the gain modification values is detected, for example by detecting the largest variation (amongst temporally neighbouring gain modification values) between an adjacent pair of gain modification values.

Then at a step 1940 the variation is compared with a threshold. If it is greater than the threshold value then control passes to a step 1950 at which the window size is reduced (unless the window size is already at a predetermined minimum size) and control returns to the step 1910. Otherwise, the current window size is accepted and control passes to an optional smoothing step 1960 before the gain modifications are applied at a step 1970 and the mixing process carried out.

FIG. 19 therefore provides an example of deriving a portion length for the successive portions so as to provide less than a threshold variation of the generated portion gain adjustments with respect to time for the given input digital audio signal.

Figure 20:
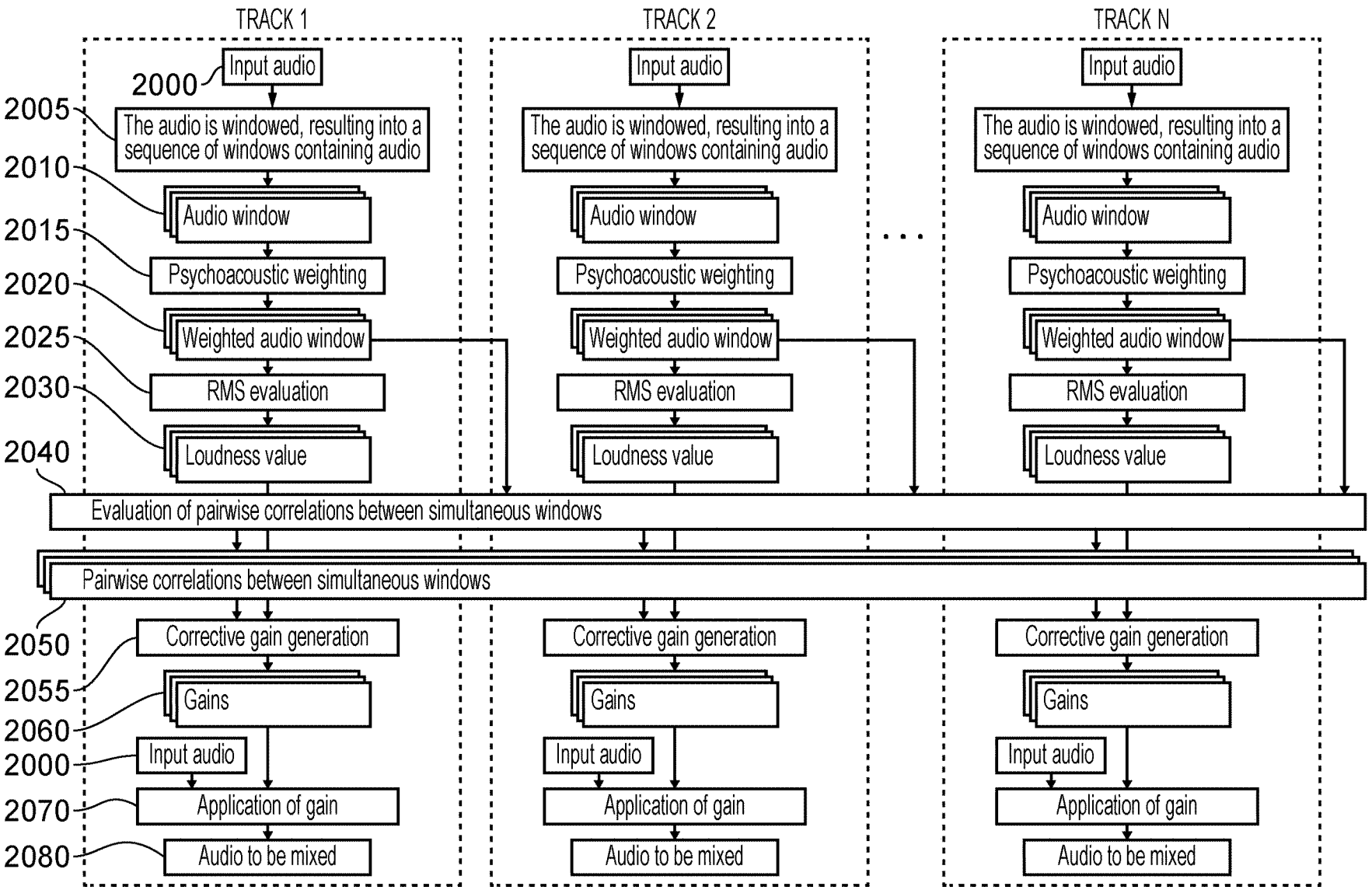
FIG. 20 schematically illustrates a method using a loudness measure.
Figure 21A:
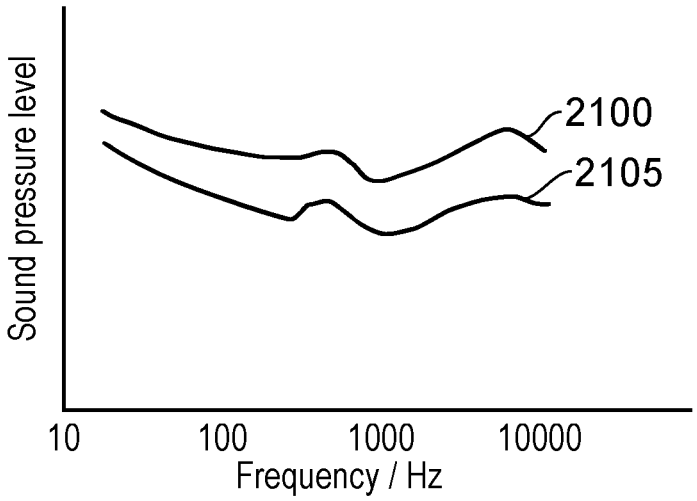
FIGS. 21*a* and 21*b* schematically illustrates examples of a loudness measure and a psychoacoustic mapping.

FIG. 20 is a schematic flowchart representing a similar process in which a so-called loudness measure is used, and FIG. 21*a* schematically represents a relationship between the level (referred to as a sound pressure level) of an audio signal, by frequency, and a contour 2100, 2105 of equal perceived loudness.

Figure 21B:
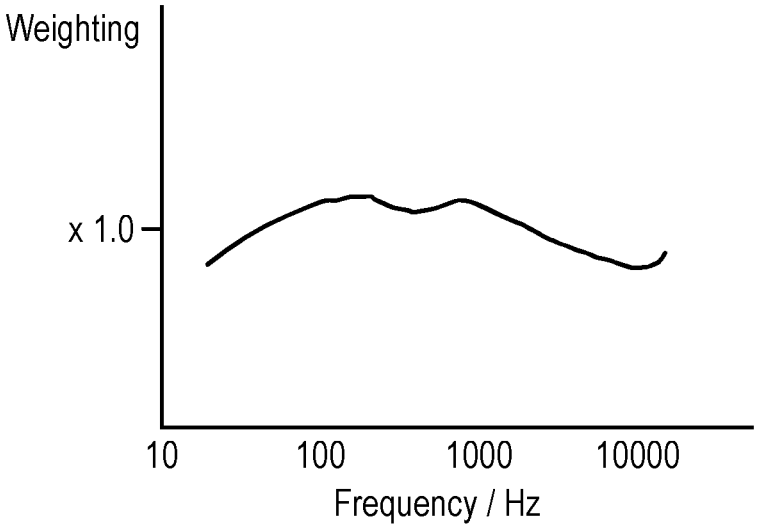

Because the human ear and brain system does not perceive loudness evenly for all frequencies, there is a relationship which can be represented as one of the contours 2100, 2105 (or several other possible contours) between perceived loudness and frequency. So, points along one of the contours as drawn will be perceived as equally loud by a listener, even though for low frequencies the actual sound pressure level may be higher than that required to achieve the same perceived loudness for high frequencies. This relationship can be applied as a mapping to the input audio signals at the step 2015 discussed above, so that the reduced influence of lower frequencies and the enhanced influence of higher frequencies to the perceived loudness are represented in the weighted audio signals. To perform this weighting, a frequency domain weighting such as that shown in FIG. 21*b* can be used, so that lower frequency components are relatively de-emphasised and higher frequency components are relatively emphasised in the weighted signal. This forms a so-called psychoacoustically weighted signal.

Returning to FIG. 20, For an input digital audio signal 2000, the audio is windowed, resulting in a sequence of windows containing portions of the audio signal, at a step 2005. These windows are represented schematically as windows 2010.

The psychoacoustic weighting 2015 is applied to each window, for example by a multi-tap filtering process, to generate weighted windows 2020.

The RMS power is evaluated at a step 2025 for each weighted audio window to generate sequences of loudness values 2030.

At a step 2040, pair-wise correlation is evaluated between windows at corresponding temporal positions resulting in a set 2050 of correlation values.

At a step 2055, the gain adjustment values are generated using similar techniques to those discussed above, but this time using the loudness values rather than simple RMS power values discussed above. This results in the generation of a set of gain adjustment values 2060 based on the psychoacoustically weighted signals but which are applied at a step 2070 to the original (non-weighted) input audio signal 2000 to generate audio 2080 to be mixed with the other input digital audio signals processed in the same way.

Therefore FIG. 20 provides an example of deriving (2015) a loudness signal from each input digital audio signal; and in which: the step of detecting a correlation comprises detecting (2040) a correlation between respective loudness signals. The actual mixing can be performed as mentioned above on the original signals.

Figure 22:
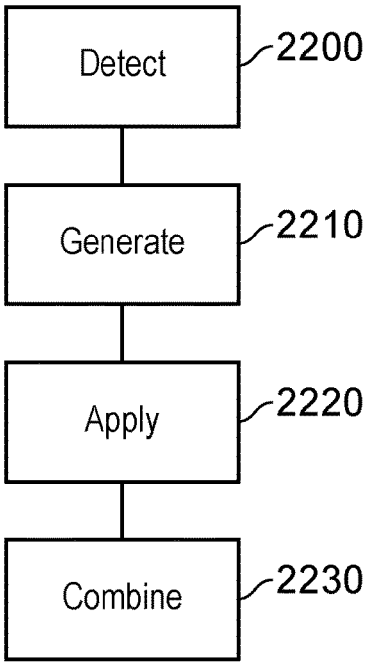
FIG. 22 is a schematic flowchart illustrating a method.

FIG. 22 is a flowchart which schematically illustrates an audio processing method comprising:

for each given input digital audio signal of a set of two or more input digital audio signals, detecting (at a step 2200) a correlation between the given input digital audio signal and others of the input digital audio signals;

generating (at a step 2210) a gain adjustment for application to the given input digital audio signal in dependence upon the detected correlation;

applying (at a step 2220) the gain adjustment to the given input digital audio signal to generate a respective gain-adjusted input digital audio signal; and combining (at a step 2230) the set of gain-adjusted input digital audio signals to generate an output digital audio signal.

Figure 23:
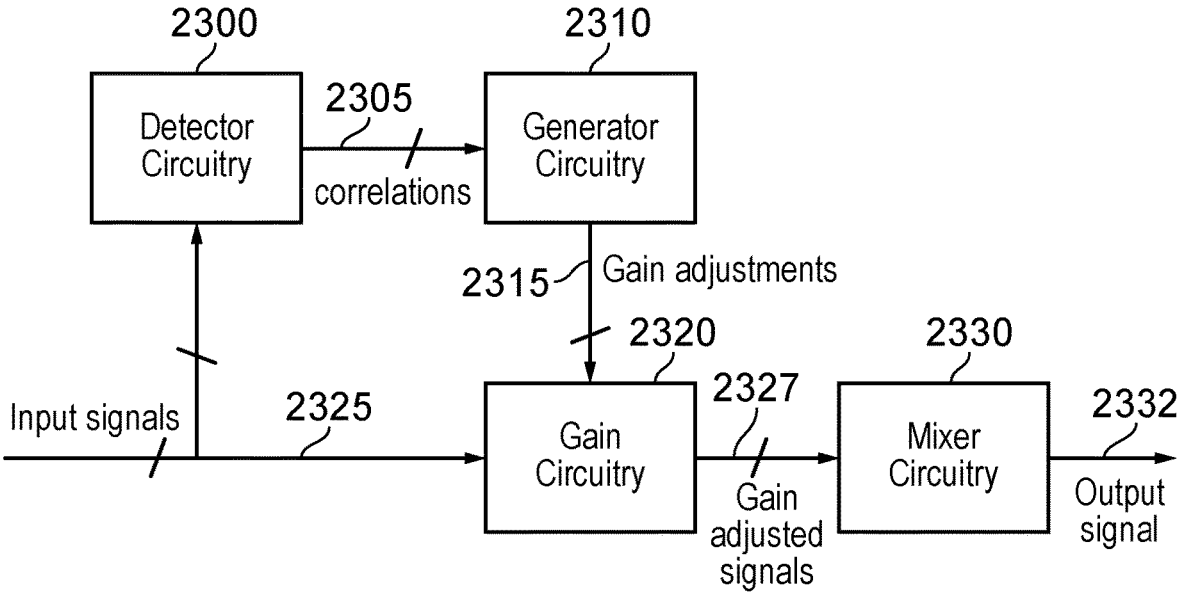
FIG. 23 schematically illustrates an audio processing apparatus.

FIG. 23 schematically illustrates audio processing apparatus to process a set of two or more input digital audio signals 2325 to generate an output digital audio signal 2332. The apparatus may be implemented for example by the apparatus of FIG. 7 or by circuitry configured to perform the functions set out below, the apparatus comprising:

detector circuitry 2300, for each given input digital audio signal of the set of two or more input digital audio signals, to detect a correlation 2305 between the given input digital audio signal and others of the input digital audio signals;

generator circuitry 2310 to generate a gain adjustment 2320 for application to the given input digital audio signal in dependence upon the detected correlation;

gain circuitry 2320 to apply the gain adjustment to the given input digital audio signal to generate a respective gain-adjusted input digital audio signal 2327; and mixer circuitry 2330 to combine the set of gain-adjusted input digital audio signals 2327 to generate the output digital audio signal 2332.

In so far as embodiments of the disclosure have been described as being implemented, at least in part, by software-controlled data processing apparatus, it will be appreciated that a non-transitory machine-readable medium carrying such software, such as an optical disk, a magnetic disk, semiconductor memory or the like, is also considered to represent an embodiment of the present disclosure. Similarly, a data signal comprising coded data generated according to the methods discussed above (whether or not embodied on a non-transitory machine-readable medium) is also considered to represent an embodiment of the present disclosure.

It will be apparent that numerous modifications and variations of the present disclosure are possible in light of the above teachings. It is therefore to be understood that within the scope of the appended clauses, the technology may be practised otherwise than as specifically described herein.

Various respective aspects and features will be defined by the following numbered clauses:

1. An audio processing method comprising:

for each given input digital audio signal of a set of two or more input digital audio signals, detecting a correlation between the given input digital audio signal and others of the input digital audio signals;

generating a gain adjustment for application to the given input digital audio signal in dependence upon the detected correlation;

applying the gain adjustment to the given input digital audio signal to generate a respective gain-adjusted input digital audio signal; and combining the set of gain-adjusted input digital audio signals to generate an output digital audio signal.

2. A method according to clause 1, in which the generating step comprises:

detecting a degree of enhancement or cancellation of the given input digital audio signal which would result from the detected correlation on mixing with the others of the input digital audio signals; and deriving the gain adjustment so as to at least partially compensate for the enhancement or cancellation.

3. A method according to clause 2, in which the deriving step comprises deriving the gain adjustment so as to compensate for the enhancement or cancellation.

4. A method according to clause 2 or clause 3, in which the step of detecting a correlation comprises detecting pair-wise correlations between the given input digital audio signal and respective ones of the others of the input digital audio signals.

5. A method according to clause 4, comprising the steps of:

applying a predetermined test to pairs of the input digital audio signals;

selectively excluding one or more pairs of the input digital audio signals from the detection of pair-wise correlation in dependence upon the result of the predetermined test.

6. A method according to clause 5, in which the applying step comprises:

detecting respective sequences of signal power values for successive windows of a pair of input digital audio signals;

detecting the power correlation of the sequences of signal power values; and comparing the detected power correlation with a threshold correlation;

and in which the step of selectively excluding comprises excluding a pair of the input digital audio signals from the detection of pair-wise correlation when the detected power correlation is less than the threshold correlation.

7. A method according to any one of the preceding clauses, in which:

the step of detecting a correlation comprises detecting a portion correlation applicable to successive portions of the given input digital audio signal; and the step of generating a gain adjustment comprises generating a respective portion gain adjustment for application to each portion of the given input digital audio signal in dependence upon the detected portion correlation.

8. A method according to clause 7, in which each successive portion represents at least ten seconds of the input digital audio signal.

9. A method according to clause 7 or clause 8, comprising the step of smoothing one or both of:

the detected portion correlations; and the generated portion gain adjustments;

with respect to time for the given input digital audio signal.

10. A method according to any one of clauses 7 to 9, comprising the step of deriving a portion length for the successive portions so as to provide less than a threshold variation of the generated portion gain adjustments with respect to time for the given input digital audio signal.

11. A method according to any one of the preceding clauses, comprising:

performing the steps of detecting a correlation and generating a gain adjustment for the set of input digital audio signals before combining the set of gain-adjusted input digital audio signals to generate an output digital audio signal.

12. A method according to any one of the preceding clauses, comprising the step of:

deriving a loudness signal from each input digital audio signal;

and in which:

the step of detecting a correlation comprises detecting a correlation between respective loudness signals.

13. A method according to any one of the preceding clauses, comprising the step of:

partitioning the set of input digital audio signals into two or more groups of input digital audio signals;

for each group of input digital audio signals, performing the detecting, generating, applying and combining steps to generate a respective intermediate digital audio signal; and for the two or more intermediate digital audio signals, performing the detecting, generating, applying and combining steps to generate the output digital audio signal.

14. Computer software comprising program instructions which, when executed by a computer, cause the computer to perform the method of any one of the preceding clauses.

15. A non-transitory machine-readable medium which stores computer software according to clause 14.

16. Audio processing apparatus to process a set of two or more input digital audio signals to generate an output digital audio signal, the apparatus comprising:

detector circuitry, for each given input digital audio signal of the set of two or more input digital audio signals, to detect a correlation between the given input digital audio signal and others of the input digital audio signals;

generator circuitry to generate a gain adjustment for application to the given input digital audio signal in dependence upon the detected correlation;

gain circuitry to apply the gain adjustment to the given input digital audio signal to generate a respective gain-adjusted input digital audio signal; and mixer circuitry to combine the set of gain-adjusted input digital audio signals to generate the output digital audio signal.

The invention claimed is:

1. An audio processing method comprising:

for each input digital audio signal of a set of two or more input digital audio signals, detecting a correlation between a given input digital audio signal and each of other input digital audio signals in the set, wherein detecting a correlation includes detecting a portion correlation applicable to successive portions of the given input digital audio signal;

generating a gain adjustment for application to the given input digital audio signal in dependence upon the detected correlation, wherein generating a gain adjustment includes generating a respective portion gain adjustment for application to each portion of the given input digital audio signal in dependence upon the detected portion correlation;

smoothing one or both of 1) detected portion correlations applicable to successive portions of the given input digital audio signal and 2) the generated portion gain adjustments with respect to time for the given input digital audio signal;

applying the gain adjustment to the given input digital audio signal to generate a respective gain-adjusted input digital audio signal; and combining the set of gain-adjusted input digital audio signals to generate an output digital audio signal.

2. The method according to claim 1, in which the generating step comprises:

detecting a degree of enhancement or cancellation of the given input digital audio signal which would result from the detected correlation on mixing with the others of the input digital audio signals; and deriving the gain adjustment so as to at least partially compensate for the enhancement or cancellation.

3. The method according to claim 1, in which the generating step comprises:

detecting a degree of enhancement or cancellation of the given input digital audio signal which would result from the detected correlation on mixing with the others of the input digital audio signals; and deriving the gain adjustment so as to fully compensate for the enhancement or cancellation.

4. The method according to claim 1, wherein detecting the correlation includes detecting pair-wise correlations between the given input digital audio signal and respective ones of each of the other input digital audio signals.

5. The method according to claim 4, comprising the steps of:

applying, during the detecting of the pair-wise correlations, a predetermined test to pairs of the input digital audio signals; and selectively excluding one or more pairs of the input digital audio signals from the detection of pair-wise correlation based on the result of the predetermined test.

6. The method according to claim 5, in which the applying step comprises:

detecting respective sequences of signal power values for successive windows of a pair of input digital audio signals;

detecting the power correlation of the sequences of signal power values; and comparing the detected power correlation with a threshold correlation;

and in which the step of selectively excluding comprises excluding a pair of the input digital audio signals from the detection of pair-wise correlation when the detected power correlation is less than the threshold correlation.

7. The method according to claim 1, in which:

the step of detecting a correlation comprises detecting a portion correlation applicable to successive portions of the given input digital audio signal; and the step of generating a gain adjustment comprises generating a respective portion gain adjustment for application to each portion of the given input digital audio signal in dependence upon the detected portion correlation.

8. The method according to claim 7, in which each successive portion represents at least ten seconds of the input digital audio signal.

9. The method according to claim 7, comprising the step of smoothing one or both of:

the detected portion correlations; and the generated portion gain adjustments;

with respect to time for the given input digital audio signal.

10. The method according to claim 7, comprising the step of deriving a portion length for the successive portions so as to provide less than a threshold variation of the generated portion gain adjustments with respect to time for the given input digital audio signal.

11. The method according to claim 1, comprising:

performing the steps of detecting a correlation and generating a gain adjustment for the set of input digital audio signals before combining the set of gain-adjusted input digital audio signals to generate an output digital audio signal.

12. The method according to claim 1, further comprising:

deriving a loudness signal from each input digital audio signal; and detecting a loudness correlation between respective loudness signals.

13. The method according to claim 1, wherein:

the set of input digital audio signals is one group of two or more groups of input digital audio signals, wherein each group generates a respective intermediate digital audio signal and wherein each of the respective intermediate digital audio signals is combined to generate the output digital audio signal.

14. A non-transitory computer-readable storage medium having computer-readable instructions thereon which, when executed by a computer, cause the computer to perform a method, comprising:

for each input digital audio signal of a set of two or more input digital audio signals, detecting a correlation between a given input digital audio signal and each of other input digital audio signals in the set, wherein detecting a correlation includes detecting a portion correlation applicable to successive portions of the given input digital audio signal;

generating a gain adjustment for application to the given input digital audio signal in dependence upon the detected correlation, wherein generating a gain adjustment includes generating a respective portion gain adjustment for application to each portion of the given input digital audio signal in dependence upon the detected portion correlation;

smoothing one or both of 1) detected portion correlations applicable to successive portions of the given input digital audio signal and 2) the generated portion gain adjustments with respect to time for the given input digital audio signal;

applying the gain adjustment to the given input digital audio signal to generate a respective gain-adjusted input digital audio signal; and combining the set of gain-adjusted input digital audio signals to generate an output digital audio signal.

15. Audio processing apparatus to process a set of two or more input digital audio signals to generate an output digital audio signal, the apparatus comprising:

circuitry configured to for each input digital audio signal of the set of two or more input digital audio signals, detect a correlation between a given input digital audio signal and each of other input digital audio signals in the set, wherein the circuitry for detecting a correlation is further configured to detect a portion correlation applicable to successive portions of the given input digital audio signal;

generate a gain adjustment for application to the given input digital audio signal in dependence upon the detected correlation, wherein the circuitry for generating a gain adjustment is further configured to generate a respective portion gain adjustment for application to each portion of the given input digital audio signal in dependence upon the detected portion correlation;

smooth one or both of 1) detected portion correlations applicable to successive portions of the given input digital audio signal and 2) the generated portion gain adjustments with respect to time for the given input digital audio signal;

apply the gain adjustment to the given input digital audio signal to generate a respective gain-adjusted input digital audio signal; and combine the set of gain-adjusted input digital audio signals to generate the output digital audio signal.

* * * * *